US010724336B2

(12) United States Patent
Stone et al.

(10) Patent No.: US 10,724,336 B2
(45) Date of Patent: Jul. 28, 2020

(54) METHOD OF CONTROLLING DEGRADATION OF A DEGRADABLE MATERIAL

(71) Applicants: Matthew Stone, Humble, TX (US); Herb Dhuet, Richmond, TX (US); Colin Andrew, Cypress, TX (US); Crystal Lowe, Houston, TX (US)

(72) Inventors: Matthew Stone, Humble, TX (US); Herb Dhuet, Richmond, TX (US); Colin Andrew, Cypress, TX (US); Crystal Lowe, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/178,976

(22) Filed: Nov. 2, 2018

(65) Prior Publication Data

US 2019/0153815 A1 May 23, 2019

Related U.S. Application Data

(60) Provisional application No. 62/587,687, filed on Nov. 17, 2017.

(51) Int. Cl.

| | |
|---|---|
| ***E21B 34/10*** | (2006.01) |
| ***E21B 34/14*** | (2006.01) |
| ***E21B 43/26*** | (2006.01) |
| *E21B 34/00* | (2006.01) |

(52) U.S. Cl.

CPC ..... *E21B 34/10* (2013.01); *E21B 34/14* (2013.01); *E21B 43/26* (2013.01); *E21B 2034/002* (2013.01)

(58) Field of Classification Search

CPC ..... E21B 34/10; E21B 34/14; E21B 43/26

See application file for complete search history.

(56) References Cited

U.S. PATENT DOCUMENTS

| | | | | |
|---|---|---|---|---|
| 8,573,295 | B2 * | 11/2013 | Johnson | E21B 29/02 166/193 |
| 8,584,746 | B2 * | 11/2013 | Marya | E21B 33/12 166/192 |
| 9,546,534 | B2 * | 1/2017 | Lecerf | E21B 33/134 |
| 9,915,116 | B2 * | 3/2018 | Jacob | E21B 27/02 |
| 10,358,892 | B2 * | 7/2019 | Wakefield | E21B 34/063 |
| 2013/0146302 | A1 * | 6/2013 | Gaudette | E21B 31/002 166/376 |
| 2014/0131045 | A1 * | 5/2014 | Loiseau | E21B 43/119 166/305.1 |
| 2015/0369003 | A1 * | 12/2015 | Hajjari | E21B 29/002 166/298 |
| 2017/0247997 | A1 * | 8/2017 | Kovalevsky | E21B 43/267 |
| 2018/0128082 | A1 * | 5/2018 | Hollan | E21B 34/14 |
| 2019/0055800 | A1 * | 2/2019 | Stone | E21B 21/10 |

* cited by examiner

*Primary Examiner* — Matthew R Buck

(74) *Attorney, Agent, or Firm* — Cantor Colburn LLP

(57) ABSTRACT

A method of controlling degradation of a degradable material including forming a fluid in a hydration unit, admixing one or more additives to the fluid in a blender, introducing the fluid into a wellbore, injecting a degradation fluid between the hydration unit and the blender. The degradation fluid forms a degradation zone in the fluid. A degradable component formed from a degradable material is introduced into the degradation zone, and the degradable material and the degradation zone is pumped into a wellbore.

10 Claims, 4 Drawing Sheets

METHOD OF CONTROLLING DEGRADATION OF A DEGRADABLE MATERIAL

CROSS REFERENCE TO RELATED APPLICATIONS

This application claims the benefit of an earlier filing date from U.S. Provisional Application Ser. No. 62/587,687 filed Nov. 17, 2017, the entire disclosure of which is incorporated herein by reference.

BACKGROUND

In the resource recovery and extraction industry, various degradable materials are used to control fluid flow and/or activate mechanisms arranged in a borehole. In a fracturing operation, often times degradable check balls are pumped downhole with a fracturing fluid. The check balls seat against a ball set, and pressure is applied to the fracturing fluid to create a fracture in a formation. Over time, the check ball degrades and may pass or be pumped through the ball seat. The fracturing fluid is designed to have properties that promote fracturing and degradation of the check ball.

Given that the fracturing fluid is designed to accommodate multiple tasks, fracturing being a primary task, degradation of the check ball may take time. More specifically, the fracturing fluid is not specifically designed to degrade the check ball as a primary task. Thus, often times it may take an extended time to promote degradation of the check ball. During that time, operation at the borehole may be put on hold. Therefore, the art would be receptive to a method of targeting degradation of a downhole component without diminishing other properties of a downhole fluid.

SUMMARY

Disclosed is a method of controlling degradation of a degradable material including forming a fluid in a hydration unit, admixing one or more additives to the fluid in a blender, introducing the fluid into a wellbore, injecting a degradation fluid between the hydration unit and the blender. The degradation fluid forms a degradation zone in the fluid. A degradable component formed from a degradable material is introduced into the degradation zone, and the degradable material and the degradation zone is pumped into a wellbore.

Also disclosed is a method of introducing fluid into a wellbore including forming a fluid having a first pH in a hydration unit, admixing one or more additives to the fluid in a blender, introducing the fluid into a wellbore, injecting a fluid having a selected pH that is distinct from the first pH, forming a zone in the fluid having the selected pH, and pumping the zone into a wellbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
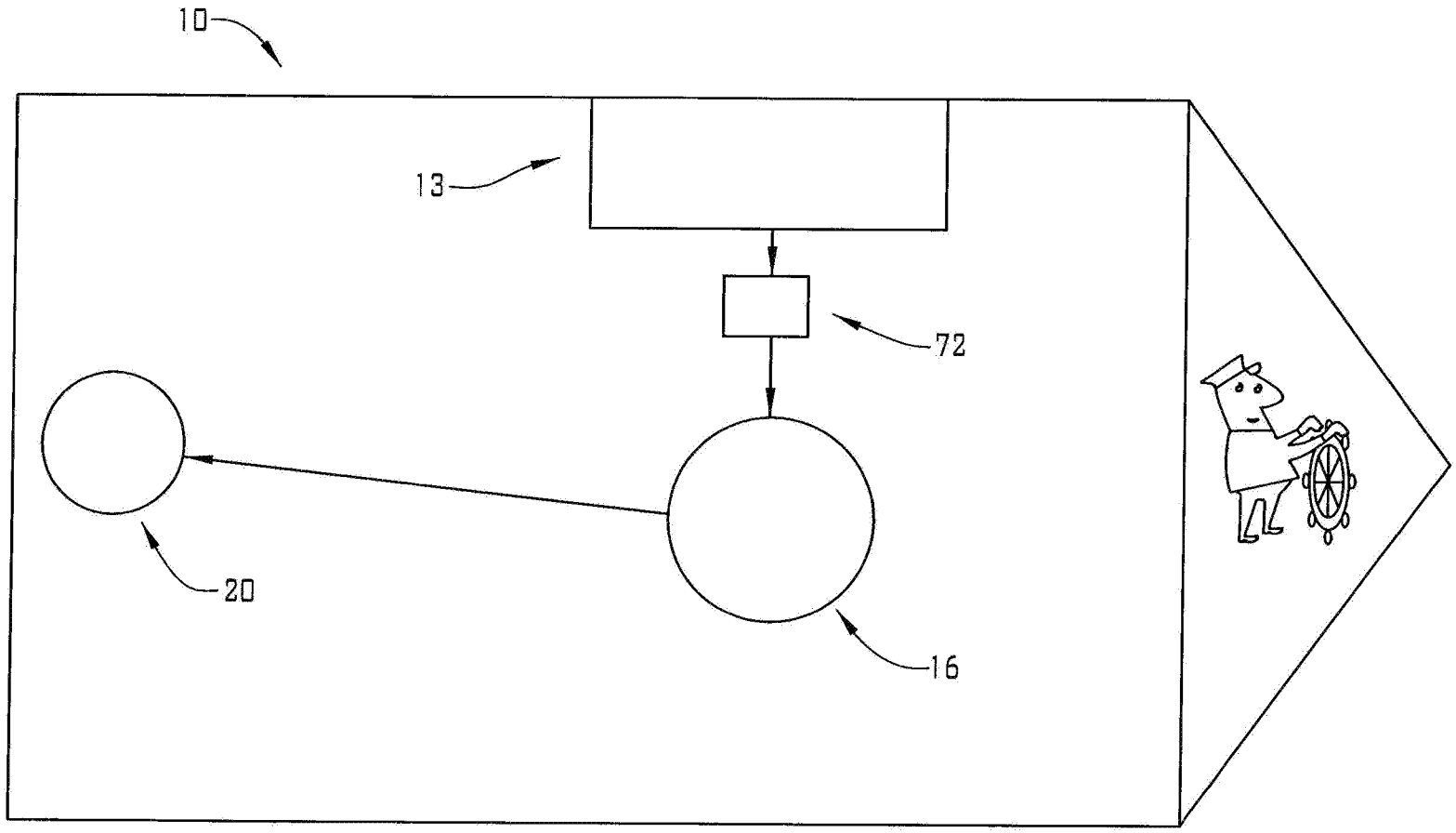
FIG. 1 depicts a resource exploration and recovery vessel, in accordance with an aspect of an exemplary embodiment.
Figure 2:
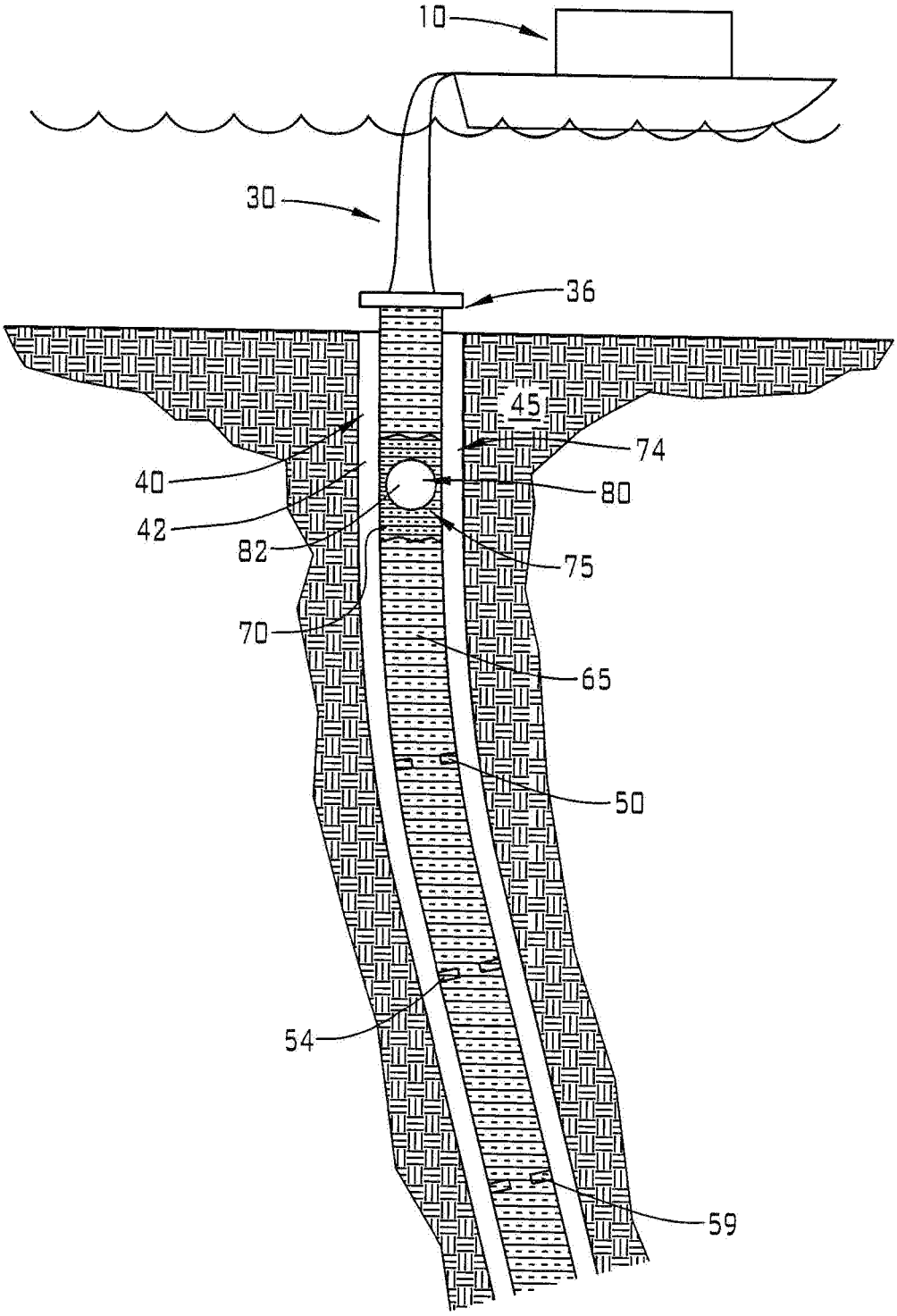
FIG. 2 depicts a tubular system including a degradation fluid forming a degradation zone, in accordance with an aspect of an exemplary embodiment.

A resource exploration and recovery vessel, in accordance with an aspect of an exemplary embodiment, is indicated generally at 10 in FIG. 1. Resource exploration and recover vessel 10 supports a hydration unit 13 that is fluidically connected to a blender 16. Blender 16 is fluidically connected to a pipe connector 20. Pipe connector 20 is connected, through a first tubular system 30, to a subsea well head 36 as shown in FIG. 2. Tubular system 30 may be formed from a plurality of distinct tubulars or from one continuous tubular.

Subsea well head 36 is connected to a second tubular system 40 that extends into a wellbore 42 formed in a formation 45. Second tubular system 40 may be formed from a plurality of distinct tubulars or from a single continuous tubular. Second tubular system 40 may include a first ball seat 50, a second ball seat 54 and a third ball seat 59. Ball seats 50, 54, and 59 may define one or more resource bearing zones (not separately labeled) in formation 45.

In accordance with an aspect of an exemplary embodiment, a fluid, such as a linear gel having a first pH is mixed in hydration unit 13. The fluid is formed from various constituents designed to, for example, promote a fracture in formation 45. One or more additives such as cross links and the like may be added to the fluid in blender 16 to form a first fluid or fracturing fluid 65. First fluid 65 is passed through first tubular system 30 and into second tubular system 40.

Prior to a pressuring up operation to promote a fracture, a second fluid or degradation fluid 70 is introduced into first tubular system 30. Degradation fluid 70 is introduced at an injector system 72 arranged between hydration unit 13 and blender 16. Degradation fluid 70 forms a degradation zone 74 in first fluid 65. Degradation zone 74 may be bordered by, and distinct from first fluid 65. For example, degradation zone 74 may possess a selected pH that is distinct from a pH of first fluid 65. A degradable component 75 which may take the form of a check ball 80 may be introduced with second fluid 70. Degradable component 75 is formed from a degradable material 82 designed to degrade when exposed to second fluid 70.

Figure 3:
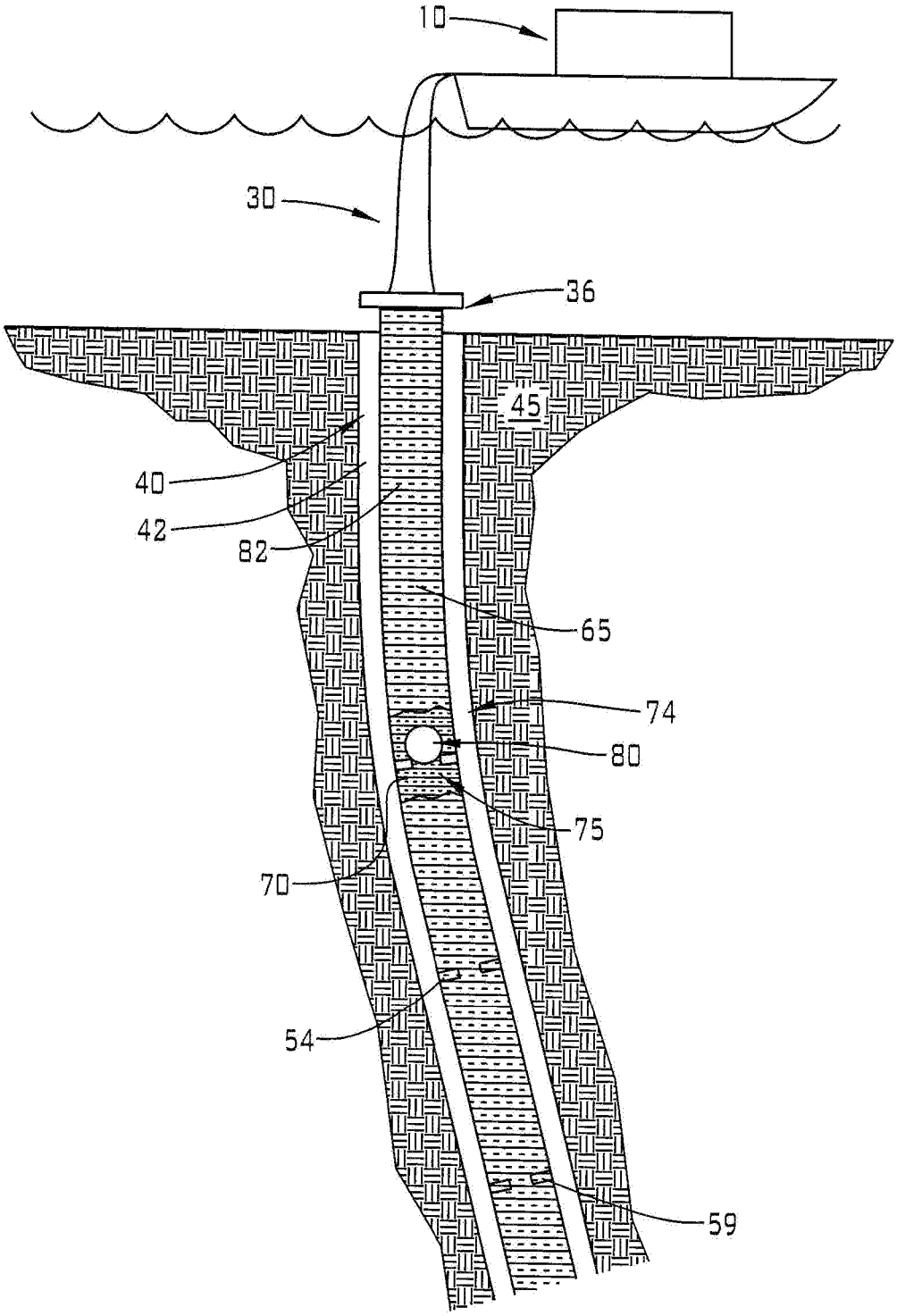
FIG. 3 depicts a check ball in the degradation zone being pumped to a first ball seat, in accordance with an aspect of an exemplary embodiment.

In further accordance with an exemplary embodiment, degradable component 75 together with degradation zone 74 is pumped in a downhole direction into wellbore 42 through second tubular system 40 to first ball seat 50 as shown in FIG. 3. Degradable component 75 may start to degrade while being pumped down to first ball seat 50. A pressure up operation may occur above first ball seat 50. The pressure up operation may be started to initiate a fracture or a treatment operation of formation 45. During the pressure up operation, degradable component 75 may continue to degrade. Given the specific degradation environment achieved by degradation zone 74 the degradable component will degrade over a short period of time. For example, degradation of degradable component 75 may occur in hours with the implementation of degradation zone 74 as opposed to days with existing technology. Further, in alternate embodiments, degradation zone 74 may be manipulated to increase degradation time over that which may be achieved through first fluid 65.

Figure 4:
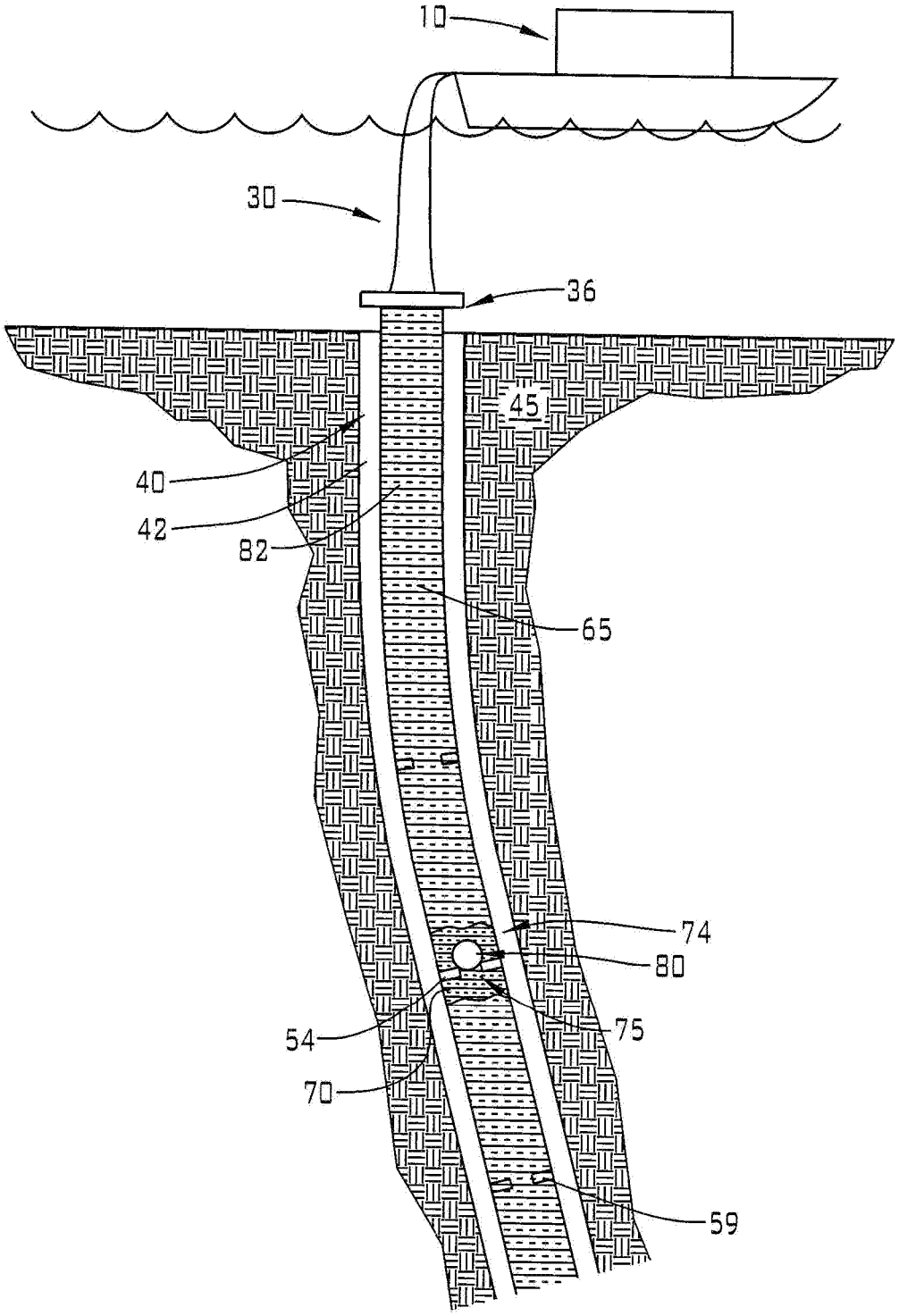
FIG. 4 depicts the check ball and degradation zone being pumped to a second ball seat.

Once sufficiently degraded degradable component 75 may be pumped through ball seat 50, together with degradation fluid 70, to second ball seat 54 as shown in FIG. 4. At this point, another pressure up operation may commence. At this point, it should be understood, that the exemplary aspects describe a method and system that enables operators to manipulate a pH or other attribute of a specific zone of fluid.

Also, while described as being pumped downhole with the degradable component, the degradation zone may be pumped downhole to a degradable component affixed to, for example, a tubular. In such a case, the degradation zone may possess one or more detectable attributes, such as conductivity, that may be sensed downhole. Once the degradable zone is in position, pumping may be held for a period of time allowing the degradable component to degrade.

Set forth below are some embodiments of the foregoing disclosure:

Embodiment 1: A method of controlling degradation of a degradable material includes forming a fluid in a hydration unit, admixing one or more additives to the fluid in a blender, introducing the fluid into a wellbore, injecting a degradation fluid between the hydration unit and the blender, the degradation fluid forming a degradation zone in the fluid, introducing a degradable component formed from a degradable material into the degradation zone, and pumping the degradable material and the degradation zone into a wellbore.

Embodiment 2: The method according to any prior embodiment, wherein introducing the degradable component includes introducing a check ball into the degradable zone.

Embodiment 3: The method according to any prior embodiment, wherein pumping the check ball into the wellbore includes pumping the check ball to a ball seat arranged along a tubular string.

Embodiment 4: The method according to any prior embodiment, further including initiating degradation of the check ball in the degradation zone prior to reaching the ball seat.

Embodiment 5: The method according to any prior embodiment, further including pumping the check ball and the degradation zone past the ball seat to another ball seat.

Embodiment 6: The method according to any prior embodiment, wherein pumping the degradation zone into the wellbore includes pumping a degradation fluid that is bordered by and distinct from the fluid.

Embodiment 7: A method of introducing fluid into a wellbore includes forming a fluid having a first pH in a hydration unit, admixing one or more additives to the fluid in a blender, introducing the fluid into a wellbore, injecting a fluid having a selected pH that is distinct from the first pH, forming a zone in the fluid having the selected pH, and pumping the zone into a wellbore.

Embodiment 8: The method according to any prior embodiment, further including exposing a degradable component formed from a degradable material to the zone.

Embodiment 9: The method according to any prior embodiment, wherein exposing the degradable component includes introducing a check ball into the zone.

Embodiment 10: The method according to any prior embodiment, wherein pumping the zone into the wellbore includes pumping the check ball enveloped by the zone to a ball seat.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of controlling degradation of a degradable material comprising:

forming a downhole fluid in a hydration unit;

admixing one or more additives to the downhole fluid in a blender;

introducing the downhole fluid into a wellbore;

injecting a degradation fluid in an uncontained state between the hydration unit and the blender, the uncontained degradation fluid forming a degradation zone in the downhole fluid;

introducing a degradable component formed from a degradable material into the degradation zone; and pumping the degradable component and the degradation zone downhole.

2. The method of claim 1, wherein introducing the degradable component includes introducing a check ball into the degradation zone.

3. The method of claim 2, wherein pumping the degradable component downhole includes pumping the check ball to a ball seat arranged along a tubular string.

4. The method of claim 3, further comprising: initiating degradation of the check ball in the degradation zone prior to reaching the ball seat.

5. The method of claim 3, further comprising: pumping the check ball and the degradation zone past the ball seat to another ball seat.

6. The method of claim 1, wherein pumping the degradation zone downhole includes pumping the downhole fluid and the uncontained degradation fluid downhole, the uncontained degradation fluid being bordered by and distinct from the downhole fluid.

7. A method of introducing fluid into a wellbore comprising:

forming a downhole fluid having a first pH in a hydration unit;

admixing one or more additives to the downhole fluid in a blender;

introducing the downhole fluid into a wellbore;

injecting a fluid having a selected pH in an uncontained state into the wellbore, the selected pH being distinct from the first pH;

forming a zone in the downhole fluid having the selected pH; and pumping the zone downhole.

8. The method of claim 7, further comprising: exposing a degradable component formed from a degradable material to the zone.

9. The method of claim 8, wherein exposing the degradable component includes introducing a check ball into the zone.

10. The method of claim 9, wherein pumping the zone downhole includes pumping the check ball enveloped by the zone to a ball seat.

* * * * *